US006081930A

United States Patent [19]

Phillips

[11] Patent Number: 6,081,930

[45] Date of Patent: Jul. 4, 2000

[54] PANTS CLOSURE

[75] Inventor: Douglas Phillips, Camp Sherman, Oreg.

[73] Assignee: Metolius Mountain Products, Inc., Bend, Oreg.

[21] Appl. No.: 09/363,595

[22] Filed: Jul. 29, 1999

[51] Int. Cl.[7] ..... A41D 1/06

[52] U.S. Cl. ..... 2/237

[58] Field of Search ..... 2/229, 235, 236, 2/237, 311, 322, 338, 342, 251, 252, 257, 220, 221; D2/627

[56] References Cited

U.S. PATENT DOCUMENTS

| | | | |
|---|---|---|---|
| 1,066,529 | 7/1913 | Robinson | 2/221 |
| 1,120,814 | 12/1914 | Hebbard | 2/220 |
| 1,614,965 | 1/1927 | Margolith | 2/236 |
| 1,776,614 | 9/1930 | Bauer | 2/237 |
| 2,418,772 | 4/1947 | Jackson | 2/235 |
| 2,847,677 | 8/1958 | Robertson | 2/237 |

*Primary Examiner*—John J. Calvert
*Assistant Examiner*—Alissa L. Hoey
*Attorney, Agent, or Firm*—Ipsolon LLP

[57] ABSTRACT

A pair of pants includes a closure system in which the first end of a belt is fixed to the waistband of the pants at the first flap of the fly opening. The belt extends circumferentially around the waistband and is adjustably connected to the second end of the waistband near the underlapping flap of the fly opening, without spanning the fly opening between the overlapping and underlapping flaps. The belt length may be adjusted. Because the belt does not span the fly opening the fly may be opened and closed in a standard fashion without the need to disconnect or reconnect the belt each time the fly is opened. The belt length need be set only once.

10 Claims, 2 Drawing Sheets

PANTS CLOSURE

FIELD OF THE INVENTION

This invention relates to a garment closure, and more specifically to a closure mechanism for pants that may be adjusted once to fit the user's waist and then opened and closed multiple times without further adjustment.

BACKGROUND AND SUMMARY OF THE INVENTION

Although a wide variety of pants closure mechanisms exist, the most familiar of such mechanisms illustrates the purpose of the present invention. Those who wear pants are familiar with the standard routine of donning the pants: when the pants are put on and adjusted to the proper position on the wearer's waist, the fly of the pants is closed and a belt is tightened to the desired tension. Removing the pants is just as routine. Because the belt spans the two flaps that comprise the fly of the pants, the belt must be loosened and the two ends of the belt disconnected from one another. This allows the flaps of the fly to be separated so that the pants may be removed.

This basic procedure for opening and closing pants is repeated many times per day. In most circumstances it is neither a difficult nor inconvenient procedure to follow. However, in some circumstances the process of reattaching and readjusting a belt each time the fly is opened can be difficult. For instance, participants in some sporting activities do not always have two hands available for the amount of time needed to readjust a belt. Consider the example of a rock climber. During long climbs, which may take several days, it will in the normal course of affairs be necessary to occasionally loosen the waistband of the pants. During such times, when perched for instance on a rock wall, it may be undesirable or unsafe to remove both hands from their grip on the wall for any length of time. And it likely is difficult to gain enough freedom of movement to comfortably undo and then attach and readjust a belt. The normal routine of donning a pair of pants under these conditions is thus somewhat more difficult. These same problems are present in many active sports.

But even in non-sporting activities it would be convenient for many people to not reattach and readjust a belt each and every time they don or re-don a pair of pants. This inconvenience is alleviated with a pair of pants that has an elastic waistband. But while an elastic waistband allows the wearer to forgo a belt, many individuals choose not to wear elastic banded trousers. Thus, it would be advantageous for a pants closure device for belted trousers to allow the wearer to adjust belt system once, and to not have to reattach and readjust the belt each time the fly is opened.

The pants closure of the present invention allows the wearer to adjust a belt system once according to preference, then undo and re-do the fly on the pants multiple times without ever having to readjust the belt. The invention is built into pants having traditional construction, and utilizes a belt that is fixed at one end on one flap of the fly panel. The belt extends around the waist of the pants and the opposite free end of the belt is connected at the opposite flap of the fly panel. The free end of the belt is connected to the opposite flap with an adjustment mechanism that allows for selective tensioning of the belt. Because the belt does not span the two fly panels, the fly may be opened and closed multiple times while allowing the adjustment of the belt to stay the same.

DETAILED DESCRIPTION OF PREFERRED EMBODIMENTS

Figure 1:
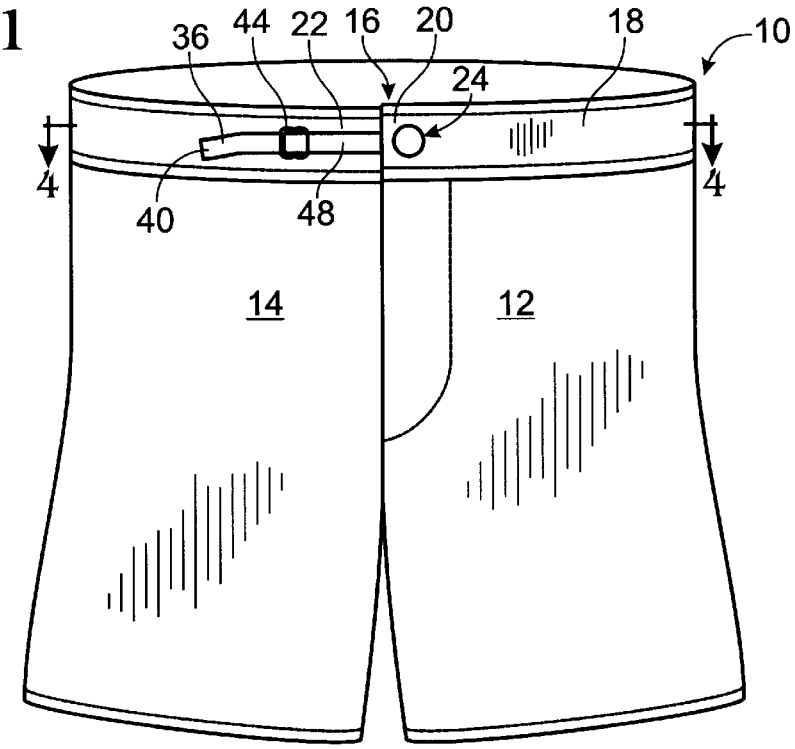
FIG. 1 is a front perspective view of a pair of pants incorporating the closure of the present invention.
Figure 2:
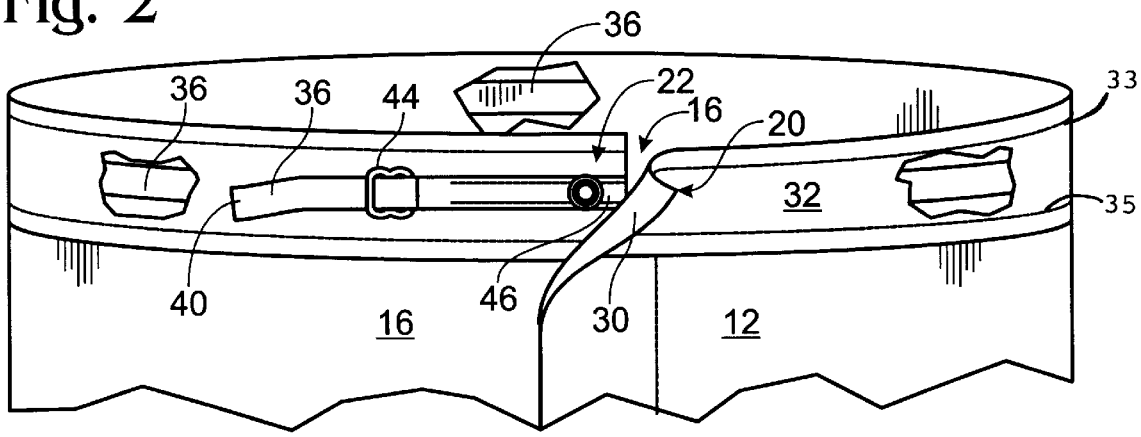
FIG. 2 is a partial fragmentary front perspective view of the pants closure of the present invention showing a portion of the waistband covering removed to expose an internal belt, and showing the fly of the pants partially opened to expose a snap closure.

Referring to FIG. 1, the preferred embodiment of a pants closure 10 according to the present invention is shown incorporated into a pair of short pants. The closure system of the present invention is most suited for use in connection with pants designed and constructed for use in sporting activities and other active uses. However, the invention may be used with virtually any pants.

The pants with which the closure may be used are typical in construction and comprise a front left panel 12 and a front right panel 14 that define between them a standard fly opening 16. A circumferential waistband 18 has opposite ends terminating at opposite sides of flaps defining a fly opening 16. Waistband 18 further defines the upper margin of fly opening 16. Thus, waistband 18 begins at a left flap 20, which defines the left side of the fly opening. Waistband 18 ends at a right flap 22, which defines the right side of the fly opening. Although not shown in the figures, fly opening 16 includes a standard closure means such as a zipper or hook and loop type fasteners to close the fly opening. In use, fly opening is closed in a standard manner with the left flap overlapping the right flap, and with the closure means connected to close the fly opening. More specifically, when a hook and loop type fastener is used, the inner-facing surface of flap 20 would be provided with either the hook segment of a standard hook and loop fastener. The outer-facing surface of flap 22 would be provided with the complimentary loop segment of the fastener in the area where flap 20 overlaps flap 22 when the fly opening is closed. Fly opening 16 is also openable in a standard manner.

Left flap 20 of waistband 18 defines an overlapping flap and is connected to the underlapping right flap 22 to close fly opening 16 with a standard snap 24 such that the left flap overlaps the right flap in the usual manner. Referring to the detailed illustration of FIG. 5, snap 24 comprises a grommeted female portion 26 that is attached in a standard manner to left flap 20 of waistband 18, and a grommeted male portion 28 that is similarly attached in a standard manner to right flap 22 of the waistband.

Figure 4:
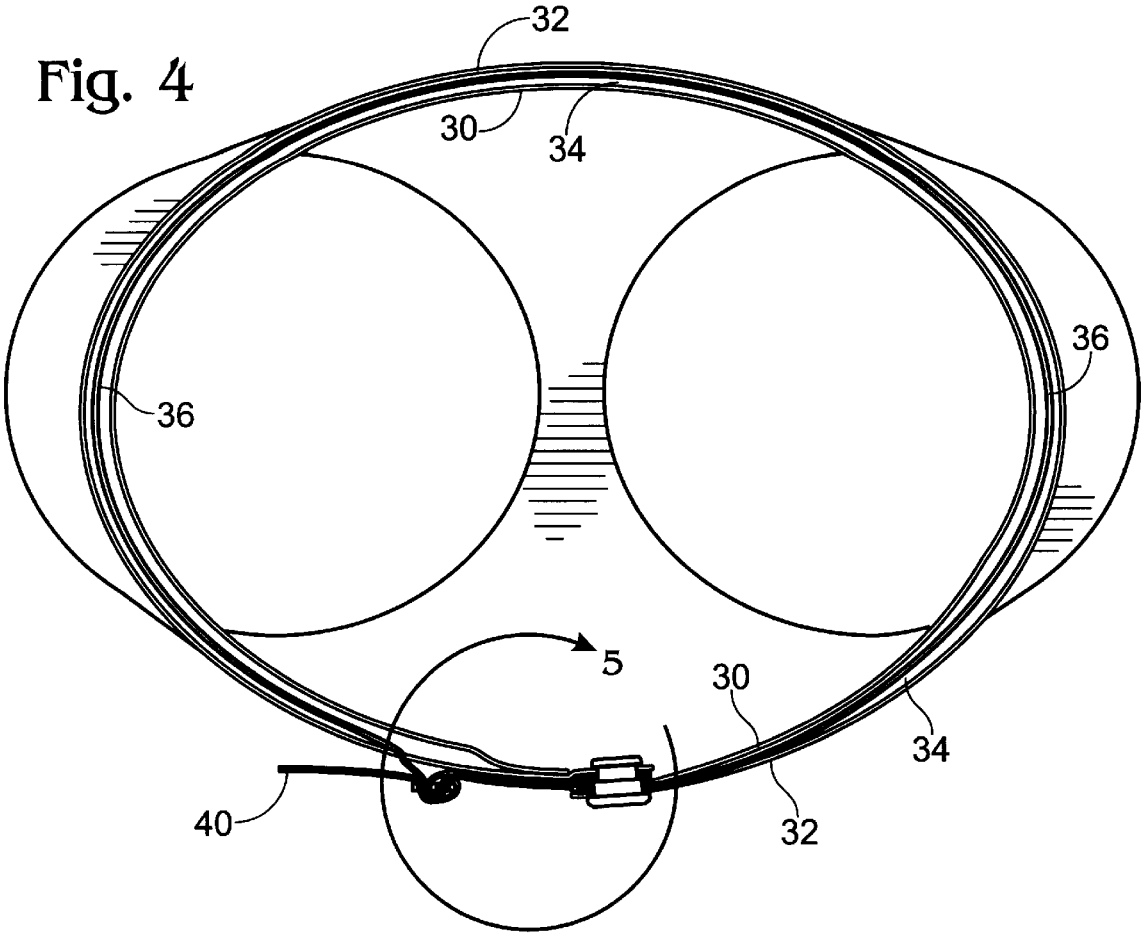
FIG. 4 is a top cross sectional view of the pants closure of the present invention, taken along the line 4—4 of FIG. 1.
Figure 5:
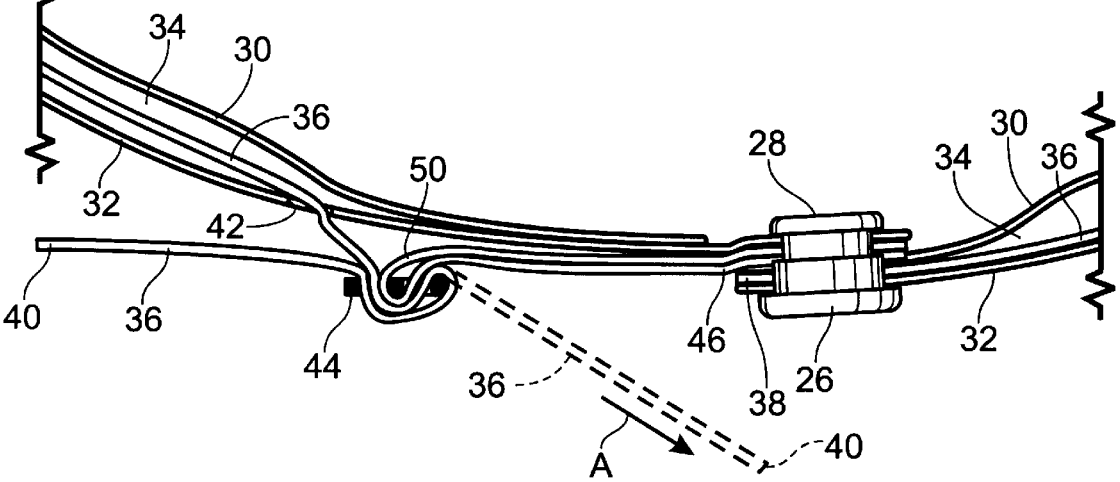
FIG. 5 is an enlarged view of the front portion of the pants closure, taken through the area of FIG. 4 bounded by enlargement circle 5.

In the embodiment shown in FIGS. 1, 2, 4 and 5, waistband 18 includes an inner panel 30 and an outer panel 32 that are stitched along circumferential lines 33 and 35 to define a passageway 34 therebetween that extends around the waistband (FIGS. 4, 5). A belt 36 extends through passageway 34. In the embodiment shown in the figures, the first end 38 of belt 36 is fixed to left flap 20 of waistband 18 with the female portion 26 of snap 24. Thus, female portion 26 comprises a grommet that extends through outer panel 32, first end 38 of belt 36, and inner panel 30, thereby fixing first end 38 of the belt in relation to the left flap 20 of waistband 18. First end 38 may additionally be stitched to the inner and outer panels for added strength. Alternately, first end 38 may be fixed to the left flap in any convenient manner.

Belt 36 extends circumferentially around the waist of the pants in passageway 34. The belt itself is contained within passageway 34 along the entire length of the belt, with the only portion of the belt that is exposed outside of passageway 34 being the opposite end 40 of belt 36, which passes out of passageway 34 through an opening 42 in outer panel 32 adjacent right flap 22 of waistband 18. As shown in FIG. 5, this hidden belt construction leaves end 40 as a free end of the belt, and the only portion of the belt that is exposed. Apart from the connection between first end 38 to the waistband, belt 36 is not fixed to the pants and is free to move longitudinally in passageway 34. Moreover, since the belt is completely contained in passageway 34, no portion of the belt is exposed except the free end. This is an advantage in situations where equipment, for example climbing equipment such as carabiners, could get caught on a belt loop or an exposed portion of a standard belt. Thus, the hidden belt construction shown in FIG. 1 is advantageous for use with pants designed for active uses such as sporting activities.

As best seen in FIG. 5, a standard three bar slide 44 is attached to the first end 50 of a length of fabric webbing 48 that is fixed at the second end 46 to right end 22 of waistband 18. More specifically, second end 46 of webbing 48 is fixed to the right flap of the waistband with the male portion 28 of snap 24, in the same manner that female portion 26 of snap 24 fixes first end 38 of belt 36 to left end 20 of the waistband. Webbing 48 may further be stitched in place to provide added strength.

End 40 of belt 36 is looped through the three bar slide 44 in a standard manner, as shown in FIG. 5.

When constructed as noted above, belt 36 has one end fixed to the left end of the waistband and the opposite end adjustably fixed to the right end of the waistband. However, the belt does not span the fly opening 16 between the left and right ends of the waistband. This allows the fly to be opened and closed without changing the tension adjustment of the belt.

In use, the first time a wearer puts on the pants incorporating the closure system of the present invention he or she will typically first snap the female and male portions of snap 24 together to close fly opening 16. The closure for the fly is then closed, whether it is a zipper or a hook and loop type closure. The free end 40 of belt 36 is then threaded through the three bar slide 44 in a standard manner such that the free end passes once through each of the two openings in the slide. This is shown in the phantom lines in FIG. 5. With the belt so connected to the slide, a circumferential belt path is defined around the waistband of the pants, beginning at the point of attachment of first end 38 to the waistband and extending around the waistband in the direction toward free end 40. The belt further defines a belt length between the first end of the belt, where it is fixed to the left end of the waistband, and the point of attachment between the belt and the three bar slide. As noted, the belt and the belt path do not span the fly opening. Stated otherwise, when left flap 20 is connected to right flap 22 such that the fly opening is closed, belt 36 does not extend between the flaps across the fly opening.

When threaded properly as just described, the tension on belt 36 is adjusted to the desired setting. For instance, decreasing the belt length causes an increase in the tension on the belt, assuming of course that the pants are being worn such that the waistband of the pants fits snuggly against the wearer's waist. Decreasing the belt length is accomplished by pulling end free 40 to thus pull belt 36 through the three bar slide in the direction of the arrow A in FIG. 5.

It will be appreciated that with most standard belts, the length of the belt is decreased (i.e., the tension on the belt is increased when the pants are being worn) by pulling the free end of the belt in the direction that is approximately between 90° to 150° from the direction of the arrow A shown in FIG. 5. In other words, known belts span the fly opening between the opposed fly flaps. To tighten the belt, a free end of the belt is connected to, for example, a loop on the on the opposite end of the belt, across the fly opening. To tighten the belt the free end of the belt is doubled back over the belt and the belt is pulled back over itself at approximately a 90° to 150° angle to the direction of the belt path at the point of contact between the belt and the loop. In contrast, pulling free end 40 in the general direction of the belt path, that is, in the direction of arrow A in FIG. 5, tightens the belt of the present invention. Since the first end of belt 36 is fixed to the left flap of the waistband and the belt is otherwise not fixed to the pants, and because flap 20 is connected to flap 22, pulling the free end of the belt through the three bar slide in the direction of the arrow in FIG. 5 decreases the belt length, tightening the belt.

The belt length may be increased and the tension on the belt may be decreased by sliding the belt back through the three bar slide such that the free end of the belt moves back toward the three bar slide. In other words, in the direction opposite arrow A in FIG. 5. When the belt is adjusted to the desired tension (that is, the belt length is set according to user preference), the user may then thread the free end of the belt back over itself and through one opening of the three bar slide as shown in the solid lines in FIG. 5. This locks the position of the belt with respect to the three bar slide and thus sets the belt length to the desired length.

With the closure adjusted as just described, fly opening 16 may be opened and closed by unsnapping snap 24 and opening the closure (e.g. the zipper) between front left panel 14 and front right panel 16. Because the belt path does not span the fly opening, the snap 24 may be selectively opened and closed without the need for detaching the ends of the belt from one another and adjusting the belt each time the fly is opened. And because the belt length is set at the desired position and tension, when the snap 24 is refastened the pants are again in the desired position.

Figure 3:
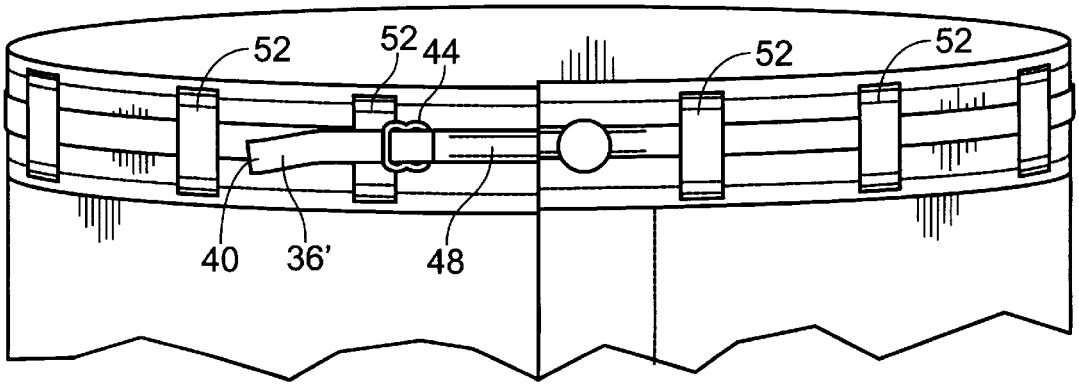
FIG. 3 is a front perspective view of an alternative embodiment of the present invention in which the belt is threaded through belt loops.

As described above with regard to the embodiment shown in FIGS. 1, 2, 4 and 5, the hidden belt 36 shown in those figures is advantageous when, for example, the closure system is being used in pants designed for active sports such as rock climbing. But the closure system of the present invention may also be incorporated with other pant designs. An alternate embodiment of the pants closure of the present invention is shown in FIG. 3. In this embodiment belt 36' extends around the waist of the pants through a plurality of belt loops 52. Belt loops 52 hold belt 36 in the proper position on the waistband, replacing passageway 34 of the embodiment of FIG. 1, and providing a different visual impact.

While the present invention has been described in terms of a preferred embodiment, it will be appreciated by one of ordinary skill that the spirit and scope of the invention is not limited to those embodiments, but extend to the various modifications and equivalents as defined in the appended claims.

What is claimed is:

1. A closure for a pair of pants, comprising:

(a) a pair of pants having a circumferential waistband with a first end defining an overlapping flap and a second end defining an underlapping flap, the overlapping and underlapping flaps defining a fly opening therebetween;

(b) a belt having a first end attached to the first end of the waistband and a second free end, the belt extending around said waistband;

(c) a fastener element attached to the second end of said waistband and adapted for engaging said belt to define a belt path having a belt length between said first end of the belt and said fastener element, wherein said belt path does not span said fly opening, and said fastener element is configured for slideable engagement with said belt for continuous slideable adjustment of the belt length;

(d) a closure element on said overlapping and underlapping flaps for selectively attaching and detaching said overlapping flap to said underlapping flap to selectively close and open said fly opening.

2. The pants closure according to claim 1 wherein the fastener element adjustably engages the belt to selectively increase or decrease the belt length.

3. The pants closure according to claim 1 wherein the overlapping and underlapping flaps may be attached and detached from one another without changing the belt length.

4. The pants closure according to claim 1 wherein the belt length may be selectively increased and decreased when said overlapping and underlapping flaps are attached to one another.

5. The pants closure according to claim 1 wherein the waistband further comprises an inner panel and an outer panel connected at opposite lateral edges thereof to define a longitudinal circumferential passageway, said passageway having an exit formed therefrom adjacent said second end of said waistband, and wherein the belt is contained within said passageway and the free end of the belt extends through said exit.

6. A method of adjusting the closure on a pair of pants, the method comprising the steps of:

(a) providing a pair of pants having a circumferential waistband with a first end defining a first flap second end defining a second flap, the combination of the first flap and the second flap defining a fly opening therebetween, said pants including a belt extending around said waistband to define a belt path and said belt having a length, the first end of said belt attached to the waistband at the first end thereof, and a cooperative closure element on said first and second flaps for selectively attaching and detaching said first flap from said second flap to selectively close and open said fly opening;

(b) closing said fly opening by connecting said closure element on said first flap to the closure element on said second flap;

(c) connecting said belt at a point along the length thereof to a fastener attached to the second end of said waistband to define a belt length between said first end of said belt and said point along the length of said belt such that the belt path does not span said closed fly; and (d) after step (b), adjusting said belt length to a selected position.

7. The method of claim 6 wherein the fastener is configured for slideable engagement with said belt, and including the step of adjusting said belt length by sliding said belt through said fastener.

8. A closure for a pair of pants, comprising:

(a) a pair of pants having a circumferential waistband with a first end defining an overlapping flap and a second end defining an underlapping flap, the overlapping and underlapping flaps defining a fly opening therebetween;

(b) a belt having a first end attached to the first end of the waistband and a second free end, the belt extending around said waistband;

(c) a fastener element attached to the second end of said waistband and adapted for slideable and continuously adjustable engagement with said belt to define a belt path having a belt length between said first end of the belt and said fastener element;

(d) a closure element on said overlapping and underlapping flaps for selectively attaching and detaching said overlapping flap to said underlapping flap to selectively close and open said fly opening.

9. The pants closure according to claim 8 wherein said belt path does not span said fly opening.

10. The pants closure according to claim 9 wherein said belt length may be selectively increased and decreased when said overlapping and said underlapping flaps are attached to one another.

* * * * *